US012031806B2

(12) United States Patent
Biedermann et al.

(10) Patent No.: US 12,031,806 B2
(45) Date of Patent: Jul. 9, 2024

(54) CARTRIDGE CASE FOR CENTERFIRE AMMUNITION, AND CENTERFIRE AMMUNITION

(71) Applicant: RUAG Ammotec AG, Thun (CH)

(72) Inventors: Peter Biedermann, Lyss (CH); Peter Spatz, Bern (CH)

(73) Assignee: RUAG Ammotec AG, Thun (CH)

( * ) Notice: Subject to any disclaimer, the term of this patent is extended or adjusted under 35 U.S.C. 154(b) by 0 days.

(21) Appl. No.: 18/248,985

(22) PCT Filed: Jul. 1, 2021

(86) PCT No.: PCT/EP2021/068248
§ 371 (c)(1),
(2) Date: Apr. 13, 2023

(87) PCT Pub. No.: WO2022/078639
PCT Pub. Date: Apr. 21, 2022

(65) Prior Publication Data

US 2023/0384065 A1 Nov. 30, 2023

(30) Foreign Application Priority Data

Oct. 14, 2020 (DE) ..... 102020127053.4

(51) Int. Cl.
*F42B 5/36* (2006.01)
*F42B 5/285* (2006.01)

(52) U.S. Cl.
CPC ..... *F42B 5/36* (2013.01); *F42B 5/285* (2013.01)

(58) Field of Classification Search
CPC .... F42B 5/36; F42B 5/285; F42B 5/26; F42B 5/28; F42B 5/307; B21D 51/54; B21K 21/04
(Continued)

(56) References Cited

U.S. PATENT DOCUMENTS 1,486,194 A * 3/1924 Newcomer ..... B21D 51/54 29/523
3,791,301 A 2/1974 La Costa
(Continued)

FOREIGN PATENT DOCUMENTS

DE 75969 C 2/1893
DE 2164413 A1 9/1972
(Continued)

OTHER PUBLICATIONS

Sep. 28, 2021 (PCT) Written Opinion and International Search Report—App. PCT/EP2021/068248.

*Primary Examiner* — Reginald S Tillman, Jr.
(74) *Attorney, Agent, or Firm* — Banner & Witcoff Ltd.

(57) ABSTRACT

A cartridge case for centerfire ammunition may include a rotationally shaped casing sleeve for receiving a projectile as well as propellant charge powder, and a separate rotationally shaped bottom piece which is attached to the casing sleeve and has a closed ignition surface to be faced towards a firing pin for ignition of the centerfire ammunition. The closed ignition surface delimits, on the firing pin side, a receiving chamber for an ignition charge. The casing sleeve may have or support an anvil extending in the direction of the ignition surface into the receiving chamber. The ammunition may have a caliber in the range from, for example, 4.6 to 12.7.

19 Claims, 4 Drawing Sheets

(58) Field of Classification Search
USPC ..... 102/464, 467–470, 439, 430, 465; 89/19.5
See application file for complete search history.

(56) References Cited

U.S. PATENT DOCUMENTS

| | | | | |
|---|---|---|---|---|
| 4,132,173 | A | 1/1979 | Amuchastegui | |
| 10,731,957 | B1 * | 8/2020 | Burrow | F42B 5/307 |
| 10,866,072 | B2 * | 12/2020 | Imhoff | F42B 5/285 |
| 11,067,370 | B2 * | 7/2021 | Imhoff | F42B 5/285 |
| 2007/0234923 | A1 | 10/2007 | Reynolds et al. | |
| 2018/0321020 | A1 * | 11/2018 | Evans | F42B 5/285 |

FOREIGN PATENT DOCUMENTS

| | | | |
|---|---|---|---|
| DE | 2720821 | A1 | 11/1977 |
| FR | 505109 | A | 7/1920 |
| WO | 2008020884 | A2 | 2/2008 |

* cited by examiner

CARTRIDGE CASE FOR CENTERFIRE AMMUNITION, AND CENTERFIRE AMMUNITION

CROSS REFERENCE TO RELATED APPLICATIONS

This patent application is a U.S. National Stage Application of PCT/EP2021/068248, filed Jul. 1, 2021, which claims priority to German Patent Application No. 102020127053.4, filed Oct. 14, 2020, each of which is incorporated herein by reference in its entirety.

BACKGROUND

Field

The present disclosure relates to a multipart cartridge case for centerfire ammunition. Furthermore, the present disclosure relates to centerfire ammunition, in particular with a caliber in the range of 4.6 to 12.7.

Related Art

Multipart cartridge cases are known in principle and are divided at least into a bottom piece facing a firing pin and a casing sleeve fixedly connected to the bottom piece. However, the known processes for joining the bottom piece and casing sleeve have proven to be in need of improvement, particularly with regard to mass production and automation.

DE 2720821 A1 discloses a cartridge case with a casing sleeve for the projectile and a rear-side bottom piece facing a firing pin for ignition of the ammunition. A separate primer is not required for the cartridge case. The casing sleeve surrounds the bottom piece and is bent around the bottom of the bottom piece for form-fitting attachment of the bottom piece and casing sleeve to one another. The bottom piece has a central receiving chamber for an ignition charge.

However, DE 2720821 A1 requires an additional felt wad to be pressed into the bottom piece for limiting and sealing the receiving chamber for the ignition charge. The felt wad is shaped to form an anvil as a counter bearing for the firing pin, wherein the anvil extends into the receiving chamber. The cartridge case according to DE 2720821 A1 therefore has disadvantages in terms of the large number of parts and the complicated assembly, in particular for inserting the felt wad and ensuring the sealing of the ignition charge receiving chamber.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

Figure 1:
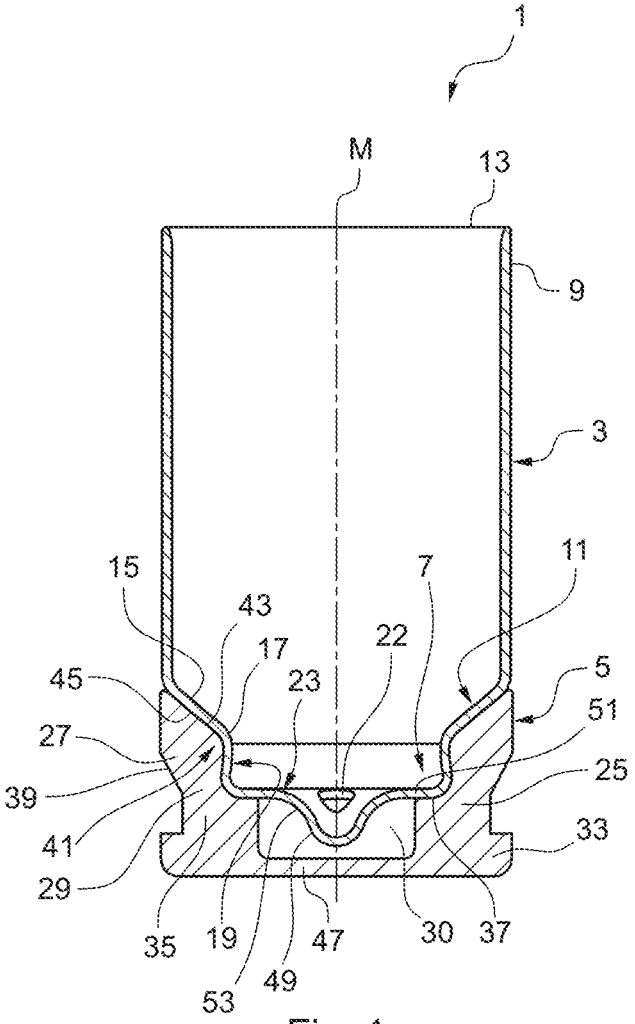
FIG. 1 is a sectional view of a cartridge case according to one or more exemplary embodiments of the present disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, and components have not been described in detail to avoid unnecessarily obscuring embodiments of the disclosure.

The present disclosure is generally concerned with the improvement and the simplification of centerfire ammunition in which a structurally separate, standard primer is not required for ignition of the centerfire ammunition.

One object of the present disclosure is to overcome the disadvantages of the prior art, in particular to simplify and/or improve a cartridge case for centerfire ammunition, in particular in such way that the number of parts is reduced compared to the prior art and/or the assembly of the cartridge case is facilitated, in particular with a simplification of the sealing of the ignition charge receiving chamber.

Whereby a cartridge case for centerfire ammunition is provided. For example, the centerfire ammunition has a caliber in the range of 4.6 to 12.7. Centerfire ammunition, also referred to as centerfire cartridge, is a cartridge with centerfire ignition. Centerfire ignition is characterized by the fact that the ignition occurs centrally with respect to the central axis or rotation axis. The ignition is initiated by a centrally guided firing pin.

The cartridge case according to the disclosure may include a rotationally shaped casing sleeve for receiving a projectile as well as propellant charge powder and a separate rotationally shaped bottom piece attached to the casing sleeve. Generic multipart cartridge cases are to be understood in the sense that the casing sleeve and the bottom piece are separate components or are manufactured separately. The attachment of casing sleeve and bottom piece may occur in such a manner as to ensure gas tightness. The bottom piece may have a central recess in which the casing sleeve is partially received. In the mutually attached state of the casing sleeve and bottom piece, an outer side of the casing sleeve rests against an inner side of the bottom piece, in particular the recess. The bottom piece may define a rotational axis. A casing-sleeve-sided annular wall of the bottom piece may be conically shaped at least sectionally with respect to its rotational axis. Furthermore, a bottom-piece-side retaining section of the casing sleeve can be form-fitted with respect to the conical annular wall, so that the retaining section engages behind the annular wall at least sectionally for attaching the casing sleeve and bottom piece to one another, and a moving away of the bottom piece and casing sleeve in the direction of the rotational axis and/or in the direction of torsion is prevented. The conical annular wall and the retaining section may be formed by plastic deformation of the bottom piece, as well as in particular of the casing sleeve. The plastic deformation can occur by force application from radially outside, in particular by pressing. In this way, a particularly simple and inexpensive cartridge case can be manufactured. In particular, a form and/or force fit between the bottom piece and the casing sleeve can be achieved in this way. The plastic deformation of the bottom piece can cause a hooking between the bottom piece and the casing sleeve, in particular in such a way that the casing sleeve is retained in the bottom piece and/or an axial and/or rotational relative movement between the casing sleeve and the bottom piece is avoided. Another advantage of this preferred realization of the attachment between the casing sleeve and the bottom piece is that, when the centerfire ammunition is fired by means of a firearm, the attachment between the casing sleeve and the bottom piece is reinforced. For example, a further plastic deformation may accompany, thereby strengthening the hooking or engagement structure. In other words, a force and/or form-fit attachment of the bottom piece and the casing sleeve can be made possible by performing deformation work. Neither the casing sleeve nor the bottom piece requires additionally introduced and/or prefabricated attachment and/or hooking structures. By the fact that the recess inner wall tapers towards the casing sleeve, it can be understood that a free or open opening cross-section of the recess is reduced. In other words, the inner wall may be inclined with respect to the central rotational axis. The plastic deformation of the bottom piece can be demonstrated, for example, in the flow structure.

According to the disclosure, the bottom piece has a closed ignition surface. The ignition surface is arranged at the rear side with respect to the flight direction of the projectile and/or is to be faced towards a firing pin for ignition of the centerfire ammunition. The ignition surface delimits, on the firing pin side and/or on the rear side, a receiving chamber for an ignition charge. In other words, the pyrotechnic ignition charge may be accommodated in the receiving chamber and thus rests on the ignition surface. Further, in accordance with the present disclosure, the casing sleeve includes or supports an anvil extending into the receiving chamber in the direction of the ignition surface. An advantage of the present disclosure is that the cartridge case according to the disclosure requires only a few parts and, to that extent, assembly is facilitated and can be realized at low cost. The advantage arises in particular from the fact that the bottom piece and casing sleeve components, which are present anyway, can be used for delimitation of the receiving chamber for the ignition charge. Furthermore, it is possible that the anvil can be formed in the bottom of the casing sleeve, which results in a further reduction in parts. The bottom piece, which is closed at the rear side, has a particularly advantageous effect on the gas-tightness of the cartridge case. Furthermore, due to the closed bottom piece shape, its stability is improved, in particular its resistance against the rear side impact of the mechanical firing pin is increased. Furthermore, it is possible to flexibly define and select the distance between the ignition surface and the anvil. The support of the anvil on the casing sleeve, in particular on a rear-side or firing pin-side bottom of the casing sleeve, can be understood in such a way that, before firing of the ammunition, there can also exist a small distance in the direction of the central axis or rotational axis, which can be bridged as a result of the impact of the firing pin on the ignition surface. If there is an axial distance between the anvil and the bottom of the casing sleeve, the anvil can be attached inside the receiving chamber by means of an interference fit against the bottom piece, in particular an annular wall which circumferentially delimits the receiving chamber.

The anvil can be rotationally symmetrical. For example, the anvil is arranged concentrically with respect to a central axis or rotational axis of the cartridge case, in particular of the casing sleeve and/or bottom piece. As a result, the anvil is directly aligned with the firing pin centrally impacting the bottom piece or its ignition surface. For example, the receptacle can be cylindrical in shape and arranged concentrically with respect to the central axis or rotational axis of the bottom piece.

In an exemplary embodiment of the cartridge case according to the disclosure, the ignition surface has a wall thickness less than an annular sleeve of the bottom piece connected to the ignition surface. In other words, the ignition surface may be weakened relative to the remaining components of the bottom piece such that the ignition surface may be deformed for initiation of the ignition of the cartridge case by means of the firing pin. For example, the formation of the ignition surface may occur such that the bottom piece apart from that remains substantially intact, in particular the annular wall adjacent to the ignition surface. For example, the ignition surface is at least 30%, 40%, 50% or 60% less in wall thickness.

In an exemplary embodiment, the casing sleeve and the anvil are made from one piece (e.g. the casing sleeve and the anvil may be integrally formed) and/or by cold forming. For example, manufacturing may occur by deep drawing or extrusion, particularly reverse extrusion. The casing sleeve may have a substantially constant wall thickness. Further, the casing sleeve may be formed to be completely open at an end opposite the anvil to receive the projectile. For example, the bottom of the casing sleeve may be cold-formed in such way as to have the shape of the anvil.

In an exemplary further development of the cartridge case according to the disclosure, the casing sleeve has a closed bottom in which the anvil is formed and which has at least one ignition hole. The ignition holes serve for ignition of the propellant charge powder to be arranged in the casing sleeve as a result of the ignition of the ignition charge. In other words, the anvil forms the bottom of the casing sleeve at least in some regions. In an intermediate state of manufacture, the casing sleeve can thus have a closed casing structure oriented downward or in the direction of the firing pin and an open casing structure oriented upward or in the firing direction, in particular a cup or mug shape, the bottom of which is subsequently cold-formed for forming of the anvil. Furthermore, the at least one ignition hole can be introduced subsequently. In an exemplary further development, three ignition holes are arranged in the bottom at a uniform distance in the circumferential direction with respect to the rotational axis or central axis and/or surround the anvil concentrically. In other words, the ignition holes can lie on a common circumferential circle which is arranged concentrically with respect to the rotational axis or central axis and/or concentrically surround the anvil.

In a further exemplary embodiment of the cartridge case according to the disclosure, the casing sleeve and the bottom piece are form-matched to one another and/or attached to one another in such a way that the receiving chamber is sealed in particular in a gas-tight manner. In this respect, no further components are necessary for sealing or closing the receiving chamber, and the components of the multipart cartridge case which are present anyway, namely the casing sleeve and the bottom piece, can be used. For example, the casing sleeve and the bottom piece can have mutually associated and coordinated support shoulders which, in the assembled state, rest on one another and define an assembly end position, as well as sleeve sections adjoining the support shoulders, which are oriented substantially in the longitudinal direction of the respective component and, for example, serve for forming a press fit between the casing sleeve and the bottom piece.

According to an exemplary further development of the cartridge case according to the disclosure, the casing sleeve and the bottom piece are pressed together. For example, an inner dimension of the bottom piece for receiving the casing sleeve may be undersized with respect to an outer dimension of the casing sleeve. In this way, a press fit between the casing sleeve and the bottom piece can be achieved, which is easy to manufacture and assemble. The insertion of the press fit can be facilitated, for example, by the effect of temperature. For example, the casing sleeve may be exposed to a low temperature prior to assembly and/or the bottom piece may be exposed to a high temperature prior to assembly so that the casing sleeve contracts and/or the bottom piece expands. After adaptation to the ambient temperature, i.e. in particular cooling or heating, a secure connection is achieved by the press fit between the casing sleeve and bottom piece.

According to another exemplary embodiment according to the present disclosure, the bottom piece has at least one support shoulder for the casing sleeve for defining an axial assembly position, in particular an end assembly position, viewed in the longitudinal direction. The longitudinal direction extends along a central/rotational axis (M). The support shoulder may be oriented transversely to the longitudinal direction. For example, the support shoulder is oriented substantially at a 90° angle to the longitudinal direction. The support shoulder may be rotationally shaped. Furthermore, it is possible for the bottom piece to have a further support shoulder which is axially offset, as viewed in the longitudinal direction, and which can likewise be formed circumferentially rotational shaped with respect to the rotational axis or central axis. The at least one further support shoulder can be oriented transversely with respect to the longitudinal direction, whereby it can form an angle in the range from 15° to 60° with respect to the longitudinal direction.

According to an exemplary further development of the cartridge case according to the disclosure, the casing sleeve supports the anvil in the longitudinal direction of the cartridge case. The anvil and the casing sleeve are separate components, in particular manufactured separately. It is possible that the anvil rests on the bottom of the casing sleeve, in particular in a planar manner. For example, the anvil forms a flat support surface with the casing sleeve, which can be oriented concentrically to the central axis or rotational axis of the casing sleeve.

According to an exemplary further development of the present disclosure, the anvil is retained in the bottom piece by a press fit. For example, the anvil is oversized with respect to the receiving chamber. For example, the anvil may be mounted in the receiving chamber under the effect of temperature. For example, the anvil can be dimensioned and/or arranged in the receptacle such that the receiving chamber is closed by means of the anvil, in particular in a gas-tight manner.

According to an exemplary further development of the cartridge case according to the disclosure, the casing sleeve has a central ignition hole, in particular with a diameter in the range from to 2 mm. In the embodiment with a separate anvil supported on the casing sleeve, a central ignition hole has proven to be advantageous for ignition of the propellant charge powder and/or in propagating an ignition spark for ignition the propellant charge powder.

According to another aspect of the present disclosure, which is combinable with the preceding aspects and exemplary embodiments, a centerfire ammunition is provided, in particular with a caliber in the range of 4.6 to 12.7. Centerfire ammunition, also referred to as a centerfire cartridge, is a cartridge with centerfire ignition. Centerfire ignition is characterized by the fact that the ignition takes place centrally with respect to the central axis or rotational axis. The ignition is initiated by a centrally guided firing pin.

The centerfire ammunition according to the disclosure comprises a cartridge case formed according to any of the aspects or exemplary embodiments described above, and an ignition charge received in the receiving chamber and/or a projectile received in the casing sleeve.

In the following description of exemplary embodiments of the present disclosure, a cartridge case for centerfire ammunition according to the disclosure is generally designated by the reference numeral 1.

In one or more exemplary embodiments, a cartridge case 1 may include: a rotationally shaped casing sleeve 3; and a rotationally shaped bottom piece 5 having a central recess 7. In one or more exemplary embodiments, the casing sleeve 3 may be partially received in the central recess 7. The cartridge case 1 may be rotationally shaped with respect to a rotational or central axis M. The axis M extends in the longitudinal direction of the cartridge case.

Figure 2:
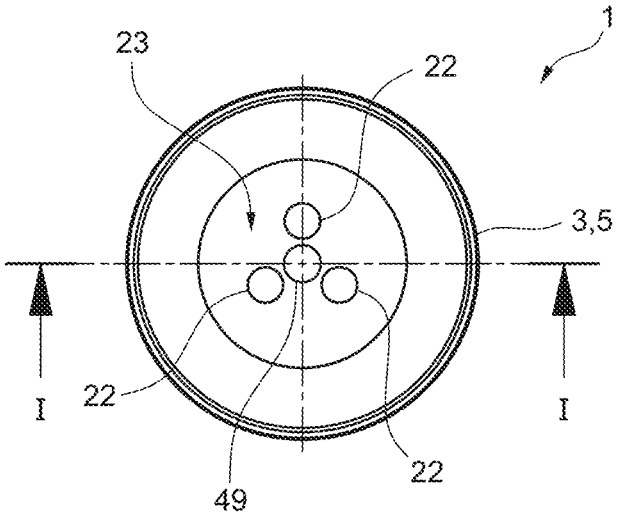
FIG. 2 is a top view of the cartridge case according to FIG. 1.
Figure 9:
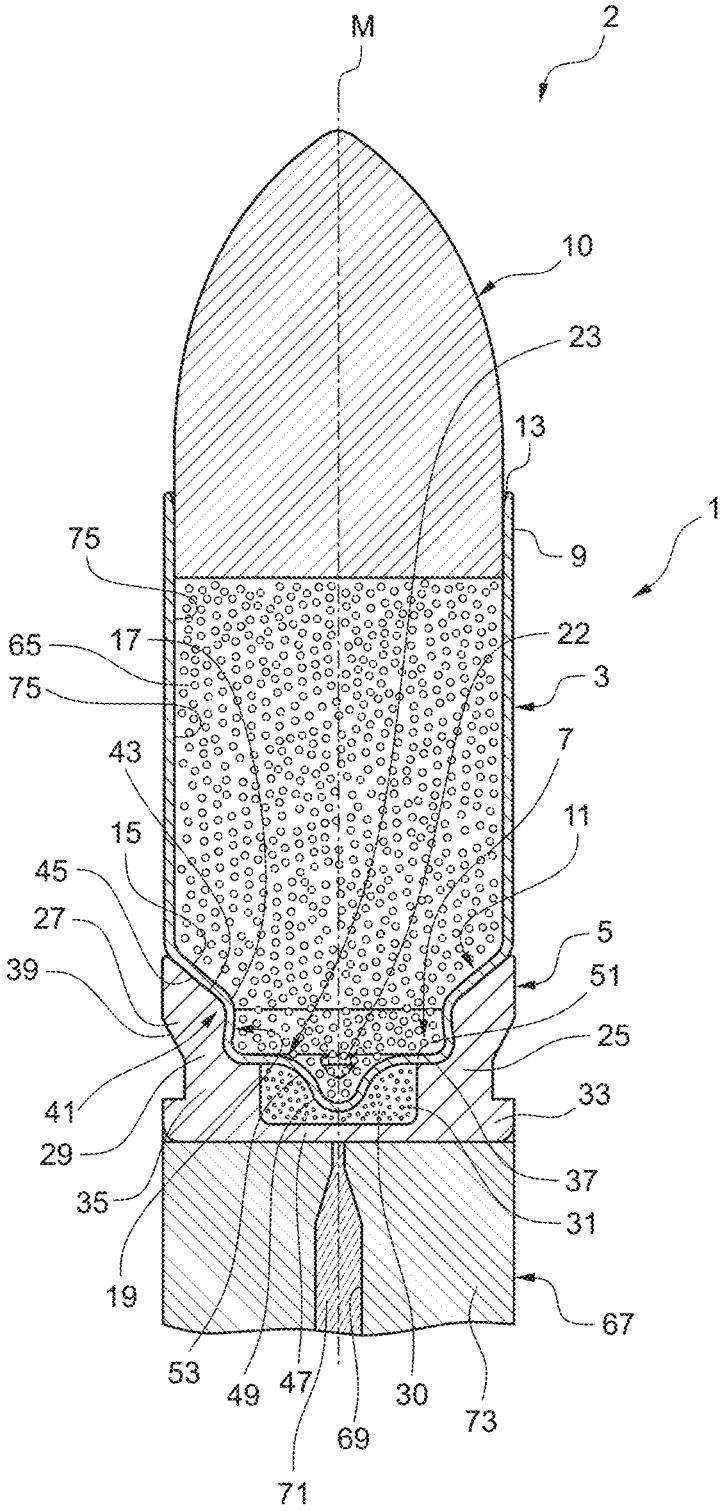
FIG. 9 is a schematic sectional view of a centerfire ammunition according to one or more exemplary embodiments of the present disclosure.

FIGS. 1 and 2 show a first exemplary embodiment of a cartridge case 1 according to the disclosure in sectional and top view. The cartridge case 1 is illustrated in FIG. 9 as part of a centerfire ammunition 2 according to an exemplary embodiment of the disclosure. The casing sleeve 3 is generally made of metal and has a substantially constant wall thickness along its longitudinal extension. The casing sleeve comprises a hollow cylinder section 9 open at the top and an adjoining neck section 11 which tapers in cross-section with respect to the cylinder section 9. The casing sleeve 3, in particular the cylinder section 9, is open on a side 13 facing away from the bottom piece 5 for receiving a projectile 10 (FIG. 9).

The neck section 11 according to FIG. 1 comprises a support shoulder 15 which is inclined with respect to the central rotational axis M in the direction of the bottom piece 5, which extends in the radial direction up to a transition 17, which can form the radially innermost point. Starting from the transition 17, the cross-section of the neck section 11 may again expand so that an undercut 19 is formed, or remain substantially constant. Finally, the bottom-side sleeve section 21 leads into a bottom 23, which can be formed to be substantially closed and implemented with ignition hole bores or ignition holes. As can be seen in FIG. 1, the casing sleeve 3, i.e. its cylinder section 9 and neck section 11, are made of one piece. For example, the casing sleeve 3 can be manufactured by deep drawing or extrusion.

The bottom piece 5 has a casing section 25 facing away from the casing sleeve 3 and a sleeve section 27 adjoining it. The sleeve section 27 may be coupled to the casing section 25 via a pivot coupling 29, which may be a film hinge, for example. It is possible that the sleeve section 27, the casing section 25 and the hinge coupling 29 are made of one piece by, for example, forming, cold forming, deep drawing, extrusion or reverse extrusion. The recess 7 goes into a receiving chamber 30 for an ignition charge 31 (FIG. 9), which is in particular cylindrically formed, in the area of the casing section 25. The casing section 25 comprises a support flange 33 on the bottom side facing away from the casing sleeve 3, which is adjoined by a substantially cylindrical section 35 of reduced wall thickness. On the inside, the cylindrical section 35 leads into a radially extending support web 37 on which the bottom 23 of the casing sleeve 3 rests. On the outside, an outer wall 39 of the bottom piece 5 sectionally expands and then extends substantially constantly, i.e. in the direction of the rotational axis or central axis M.

The bottom piece 5 is closed at the rear side or firing pin side. It has an ignition surface 47 to be faced towards the firing pin 71 (FIG. 9) on the rear side as viewed in the firing direction. The ignition surface 47 delimits the receiving chamber 30 for the ignition charge 31 at the rear side. In other words, the ignition charge 31 rests on the ignition surface 47 so that upon initiation of the ignition by means of the firing pin 71 impinging on the ignition surface 47 from the rear side, the ignition charge 31 can be ignited. This method of ignition will be discussed in detail below.

The ignition surface 47 connects the bottom flange 33 or the cylindrical section 35. Due to the closed bottom piece 5 at the rear side, optimum gas tightness is ensured. Compared to the adjoining components of the bottom piece 5, the ignition surface 47 has a significantly smaller wall thickness, in particular about 50% less, so that initiation of the ignition can reliably occur by deformation of the ignition surface 47 by means of the firing pin 71.

The sleeve section 27 may be shaped to form an undercut 41, or may be substantially hollow-cylindrical in shape and oriented substantially in the direction of the rotational axis or central axis M. It can further be seen in FIG. 1 that an inner contour 43 of the sleeve section 27 is formed substantially complementary in shape to the outer contour 45 of the neck portion 11 of the casing sleeve 3.

The attachment of the casing sleeve 3 to the bottom piece 5 can be realized by plastically deforming the sleeve section 27 of the bottom piece 5, whereby the undercut 41 is formed. At the same time, in such an embodiment, the deformation of the sleeve section 27, i.e. its radial inward bending, in particular about the pivotal coupling 29, causes a deformation of the neck section 11 of the casing sleeve 3, namely for forming the undercut 19. In this way, a reliable form and/or force fit is created between the casing sleeve 3 and the bottom piece 5 in a manner that is particularly easy to implement in terms of manufacturing technology and cost-effective to realize. Furthermore, it is also possible to attach the casing sleeve 3 and bottom piece 5 together by pressing, in particular by forming a press fit.

In one or more exemplary embodiments of a cartridge case 1 or centerfire ammunition 2 shown in FIGS. 1 and 9, respectively, the casing sleeve 3 may include anvil 49 that is integrally formed therewith, which may be configured to act as a counter bearing during the ignition of the ignition charge 31. The anvil 49 may be rotationally shaped and arranged substantially concentrically with respect to the central axis M. In particular, the anvil 49 may be formed into the bottom 23 of the casing sleeve 3. Accordingly, the bottom 23 may include an annular support portion 51 on the outer side, viewed radially with respect to the central axis M, which rests on the radial protrusion 37 forming a support shoulder for the casing sleeve 3. The annular support section 51 merges continuously into the bell- or dome-shaped anvil 49, which projects in the direction of the ignition surface 47 from the bottom 23 or the annular support section 51 and extends far into the receiving chamber 30. A distance between the ignition surface 47 and the anvil 49, viewed in the direction of the central axis M, can be a few millimeters and/or can be set or manufactured individually. Viewed from the ignition surface 47, the anvil 49 has a convex shape, which finally transitions by means of a concave curvature section 53 into the annular support section 51, which is oriented substantially transversely, in particular perpendicularly, to the central axis M.

In FIG. 2, the cartridge case 1 according to FIG. 1 is shown in top view. Furthermore, the sectional line I-I can be seen schematically, on the basis of which the sectional figure according to FIG. 1 is formed. According to the exemplary embodiment shown in FIGS. 1 and 2, three ignition holes 22 arranged concentrically with respect to the central axis M and distributed uniformly in the circumferential direction with respect to the central axis M are provided in the bottom 23 of the casing sleeve 3, via which the propellant charge powder 65 received in the casing sleeve 3 (FIG. 9) is activated. The bottom may include fewer or more ignition holes 22 in one or more other aspects.

Figure 3:
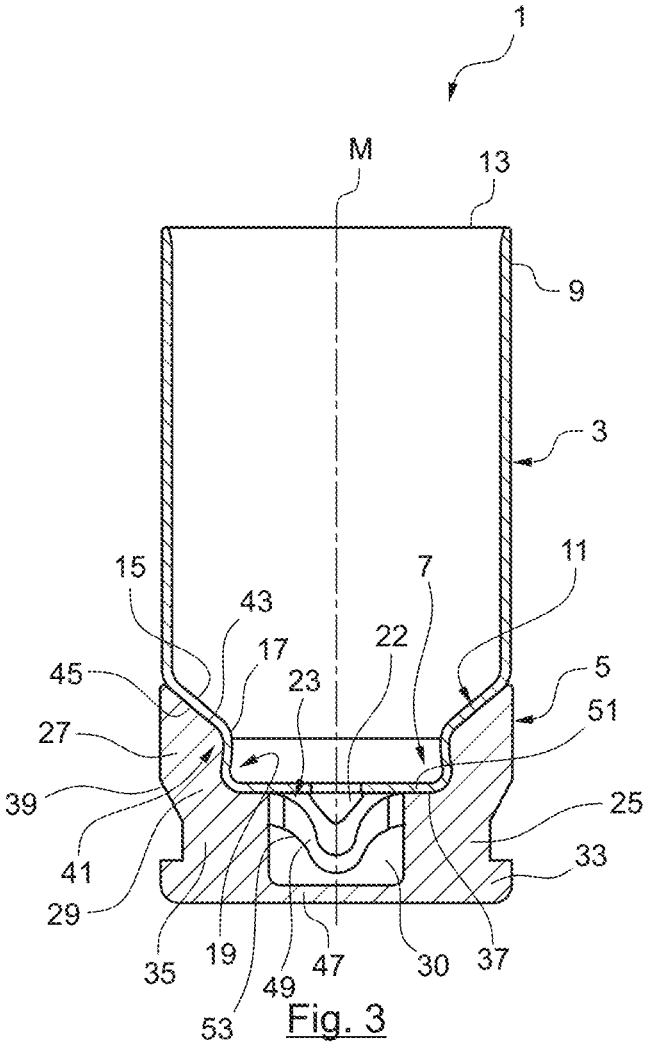
FIG. 3 is a sectional view of a cartridge case according to one or more exemplary embodiments of the present disclosure.

FIG. 3 shows a further exemplary embodiment of a cartridge case 1 according to the disclosure. In order to avoid repetitions, only the differences between the implementations shown in FIGS. 1 and 2 will be explained below.

The essential difference between the cartridge case 1 shown in FIG. 3 and the cartridge case 1 shown in FIG. 1 is that the anvil 49 and the casing sleeve 3 are not made of one piece, but are separate components. The shape, in particular the curvature, of the anvil 49 is substantially identical. The difference further lies in how the anvil 49 is secured within the receiving chamber 30. Firstly, the anvil 49 may be supported longitudinally within the cartridge case 1 on a rear surface of the bottom 23 of the casing sleeve 3. For example, the latter may rest thereon in a planar manner. Further, the anvil 49 may be attached by means of a press fit in the bottom piece, in particular in the casing section 25 which substantially laterally delimits the receiving chamber 30.

A further difference to the embodiment according to FIGS. 1 and 2 respectively is that the casing sleeve 3 has a central ignition hole 22 provided in the bottom 23, which is larger in size than the ignition holes 22 according to FIG. 2. A diameter of the ignition hole 22 can be in the range of 0.5 mm to 2 mm, for example.

Regardless of whether the casing sleeve 3 and anvil 49 are formed according to FIG. 1 or according to FIG. 2, the bottom piece 5 can be identically shaped and manufactured. The ignition of the cartridge case 1 further occurs in an analogous manner.

Figures 4, 5, 6, 7, 8:
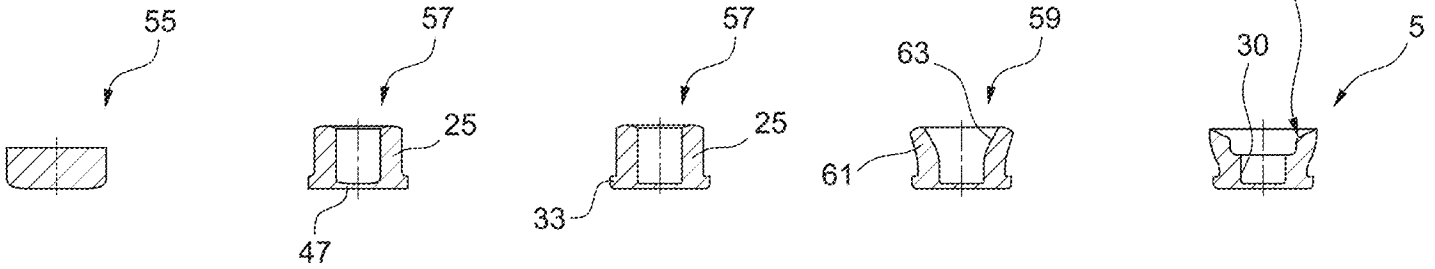
FIGS. 4-8 illustrate a manufacturing sequence for a bottom piece of a cartridge case according to one or more exemplary embodiments of the present disclosure.

FIGS. 4 to 8 show a schematic manufacturing sequence of a bottom piece 5 of a cartridge case 1 according to one or more exemplary embodiments of the disclosure. First, a metal plate 55 is produced from a metal blank (not shown), for example punched out. The metal plate 55 has, for example, a disc shape (FIG. 4). Subsequently, the basic shape of the final bottom piece 5 (FIG. 8) is already produced by a cold forming process, in particular deep drawing or extrusion, such as reverse extrusion (FIG. 5). The plate 55 is cold-formed for forming a cup 57 or a mug in such a way that essentially the casing section 25 is already completely formed or shaped, which is closed at the rear side by the ignition surface 47. The hollow casing section 25 is subsequently further formed for forming the recess 7 and the receiving chamber 30 (compare FIGS. 7 and 8). First, the rear shoulder for forming the bottom flange 33 is manufactured by pressing (FIG. 6). Then the casing section 25 is pressed on the inside for forming a cone section 61, which expands in a tulip or flower-like manner and has a cone-shaped inner contour 63. The result is a tulip- or flower-shaped cup 59 (FIG. 7). Eventually, the inner contour of the bottom piece 5 is finally pressed so that the recess 7 for receiving the casing sleeve 3 and the receiving chamber 30 for receiving the ignition charge 31 are finally formed (FIG. 8).

FIG. 9 shows an exemplary embodiment of a centerfire ammunition 2 according to the disclosure, wherein the cartridge case 1 is configured, for example, according to the embodiment of FIGS. 1 and 2. In this respect, reference can be made to the preceding explanations. On the front side, a projectile 10 is partially arranged in the casing sleeve 3 and retained by the same.

The casing sleeve 3 is further substantially completely filled with propellant charge powder 65, which is responsible for the acceleration of the projectile 10. The receiving chamber 30, which is delimited from the propellant charge powder 65 by means of the bottom 23 of the casing sleeve 3, is substantially completely filled with an ignition charge 31.

At the rear side, i.e. below in FIG. 9, of the bottom piece 5 is an ignition device 67 for the cartridge case 1. The same has a firing pin 71 guided centrally in a corresponding through hole 69, which is mounted and held in a housing 73. The firing pin 71 is dimensioned and arranged to impinge the ignition surface 47 substantially centrally so as to deform the same. As a result of the deformation of the ignition surface 47 in the direction of the anvil 49 acting as a counter-bearing, the ignition charge 31 located in the receiving chamber is squeezed and displaced, wherein as a consequence of the resulting friction between the ignition charge powder grains between them or with anvil 49 and/or ignition surface 47, the activation of the ignition charge occurs. The resulting gas expansion is transmitted via the ignition holes 22 into the interior 75 of the casing sleeve 3, in which the propellant charge powder 65 is located, in order to activate it and ultimately generate the necessary gas expansion required for acceleration and firing of the projectile 10.

A further exemplary embodiment of a centerfire ammunition according to the disclosure can be formed by means of a cartridge case 1 according to the exemplary embodiment shown in FIG. 3. The remaining structure of the centerfire ammunition 2 and its mode of operation, in particular its ignition, are carried out in an analogous manner as described above.

The features disclosed in the foregoing description, figures, and claims may be significant both individually and in any combination for the realization of the disclosure in the various embodiments.

To enable those skilled in the art to better understand the solution of the present disclosure, the technical solution in the embodiments of the present disclosure is described clearly and completely below in conjunction with the drawings in the embodiments of the present disclosure. Obviously, the embodiments described are only some, not all, of the embodiments of the present disclosure. All other embodiments obtained by those skilled in the art on the basis of the embodiments in the present disclosure without any creative effort should fall within the scope of protection of the present disclosure.

It should be noted that the terms "first", "second", etc. in the description, claims and abovementioned drawings of the present disclosure are used to distinguish between similar objects, but not necessarily used to describe a specific order or sequence. It should be understood that data used in this way can be interchanged as appropriate so that the embodiments of the present disclosure described here can be implemented in an order other than those shown or described here. In addition, the terms "comprise" and "have" and any variants thereof are intended to cover non-exclusive inclusion. For example, a process, method, system, product or equipment comprising a series of steps or modules or units is not necessarily limited to those steps or modules or units which are clearly listed, but may comprise other steps or modules or units which are not clearly listed or are intrinsic to such processes, methods, products or equipment.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

REFERENCE LIST

1 cartridge case
2 centerfire ammunition
3 casing sleeve
5 bottom piece
7 recess
9 cylinder section
10 projectile
11 neck section
13 open side
12 support shoulder
17 transition
19 undercut
21 sleeve section of casing sleeve
22 ignition hole
23 bottom
25 casing section
27 sleeve section of the bottom piece
29 hinge coupling
30 receiving chamber
31 ignition charge
33 support flange
35 cylindrical section
37 radial protrusion
39 outer contour
41 undercut
43 inner contour
45 outer contour
47 ignition surface
49 anvil
51 annular support section
53 curvature section
55 plate
57 cup
59 tulip or flower shaped cup
61 cone section

63 conically-shaped inner contour
65 propellant charge powder
67 ignition device
69 channel
71 firing pin
73 housing
75 interior
M Central/rotational axis

The invention claimed is:

1. A cartridge case for centerfire ammunition, comprising:
a rotationally shaped casing sleeve configured to receive a projectile and propellant charge powder; and
a separate rotationally shaped bottom piece attached to the casing sleeve, the bottom piece including a closed ignition surface configured to be faced towards a firing pin for ignition of the centerfire ammunition, the closed ignition surface delimiting, on the firing pin side, a receiving chamber for an ignition charge,
wherein the casing sleeve includes or is configured to support an anvil extending in the direction of the ignition surface into the receiving chamber.

2. The cartridge case according to claim 1, wherein the ignition surface has a wall thickness smaller than an annularly shaped sleeve of the bottom piece attached to the ignition surface.

3. The cartridge case according to claim 1, wherein the casing sleeve and the anvil are integrally formed.

4. The cartridge case according to claim 1, wherein the casing sleeve includes a closed bottom in which the anvil is formed and which has two or more ignition holes arranged at a uniform distance from one another and/or surrounding the anvil.

5. The cartridge case according to claim 1, wherein the casing sleeve and the bottom piece are: shape-matched to one another, and/or fastened to one another in such a way that the receiving chamber is closed.

6. The cartridge case according to claim 1, wherein the casing sleeve and the bottom piece are configured to be pressed together, an inner dimension of the bottom piece configured to receive the casing sleeve being undersized with respect to an outer dimension of the casing sleeve.

7. The cartridge case according to claim 1, wherein the bottom piece comprises at least one support shoulder, for the casing sleeve, configured to define an axial assembly position viewed in a longitudinal direction, the support shoulder being oriented transversely to the longitudinal direction.

8. The cartridge case according to claim 1, wherein the casing sleeve is configured to support anvil in a longitudinal direction of the cartridge case, the anvil being configured to rest on a bottom of the casing sleeve in a planar manner.

9. The cartridge case according to claim 1, wherein the anvil is configured to be retained by a press fit in the bottom piece, the anvil being oversized with respect to the receiving chamber.

10. The cartridge case according to claim 8, wherein the casing sleeve includes a central ignition hole.

11. The cartridge case according to claim 10, wherein the central ignition hole has a diameter of 0.5 mm to 2 mm.

12. The cartridge case according to claim 1, wherein the centerfire ammunition has a caliber of 4.6 to 12.7.

13. The cartridge case according to claim 1, wherein the casing sleeve includes a closed bottom in which the anvil is formed and which has at least one ignition hole surrounding the anvil.

14. The cartridge case according to claim 2, wherein the wall thickness of the ignition surface is at least 30% smaller than the annularly shaped sleeve of the bottom.

15. The cartridge case according to claim 5, wherein the receiving chamber is closed in a gas-tight manner.

16. The cartridge case according to claim 7, wherein the bottom piece comprises two support shoulders configured to define the axial assembly position viewed in the longitudinal direction, the two support shoulders being oriented transversely to the longitudinal direction.

17. A centerfire ammunition comprising:
a cartridge case including: a rotationally shaped casing sleeve configured to receive a projectile and propellant charge powder; and a separate rotationally shaped bottom piece attached to the casing sleeve, the bottom piece including a closed ignition surface configured to be faced towards a firing pin for ignition of the centerfire ammunition, the closed ignition surface delimiting, on the firing pin side, a receiving chamber, wherein the casing sleeve includes or is configured to support an anvil extending in the direction of the ignition surface into the receiving chamber; and
an ignition charge received in the receiving chamber and/or a projectile received in the casing sleeve.

18. The centerfire ammunition according to claim 17, wherein the centerfire ammunition has a caliber of 4.6 to 12.7.

19. A method of manufacturing a bottom piece of a cartridge case, comprising:
performing a cold forming process on a metal blank to form a hollow casing section closed at a rear side by an ignition surface;
forming a bottom flange on an exterior of the hollow casing section;
pressing on an inside surface of the hollow casing section to form a cone section, wherein the cone section expands in a tulip or flower-like manner and has a cone-shaped inner contour; and
pressing the cone-shaped inner contour to form: a recess configured to receive a casing sleeve of the cartridge case, and a receiving chamber configured to receive an ignition charge.

* * * * *